US005169434A

United States Patent [19]

Kumasaka et al.

[11] Patent Number: 5,169,434

[45] Date of Patent: Dec. 8, 1992

[54] METHOD FOR MANUFACTURING AGGLOMERATES OF SINTERED PELLETS

[75] Inventors: Akira Kumasaka; Noboru Sakamoto; Hideomi Yanaka, all of Kawasaki, Japan

[73] Assignee: NKK Corporation, Tokyo, Japan

[21] Appl. No.: 566,041

[22] Filed: Aug. 13, 1990

[30] Foreign Application Priority Data

Aug. 23, 1989 [JP] Japan ..... 1-217105

[51] Int. Cl.[5] ..... C22B 1/20

[52] U.S. Cl. ..... 75/766; 75/759; 264/56

[58] Field of Search ..... 264/56; 75/766, 759

[56] References Cited

U.S. PATENT DOCUMENTS 4,851,038 7/1989 Sakamoto et al. ..... 75/5

FOREIGN PATENT DOCUMENTS 63-149333 6/1988 Japan .

*Primary Examiner*—James Derrington

*Attorney, Agent, or Firm*—Keck, Mahin & Cate

[57] ABSTRACT

A method for manufacturing agglomerates of sintered pellets includes the steps of blending, mixing and pelletizing flux and coarse grain coke with fine iron ore, coating green pellets obtained in the step of the mixing and pelletizing with powdery coke, and sintering the green pellets coated with the powdery coke. The coarse grain coke has a particle size of 1 to 7 mm. 1 to 50 parts of the coarse grain coke, by weight, are added to 100 parts of the total amount of the fine iron ore and the flux by weight.

7 Claims, 1 Drawing Sheet

METHOD FOR MANUFACTURING AGGLOMERATES OF SINTERED PELLETS

BACKGROUND OF THE INVENTION

1. Field of the Invention

The present invention relates to a method for manufacturing agglomerates of sintered pellets, and more particularly, to a method for manufacturing agglomerates of sintered pellets as material for a blast furnace.

2. Description of Related Art

Agglomerates of sintered pellets are used for material for a blast furnace. Fine iron ore containing 40 or more wt. % fine material for pellets, flux and return fines generated at the step of manufacturing agglomerates of sintered pellets are mixed with each other. Water is added to the fine iron ore, flux and return fines. A mixture thus obtained is pelletized into green pellets of 4 to 10 mm in particle size by a disk pelletizer. The green pellets thus obtained and powdery coke are supplied into a drum mixer. The surfaces of the green pellets are coated with the powdery coke in the drum mixer. Agglomerates of sintered pellets are manufactured by sintering green pellets coated with the powdery coke in a travelling endless grate type sintering machine. A method for coating the surfaces of the green pellets is disclosed in Japanese Laid Open Patent Publication No. 149333/88. The powdery coke, with which the surfaces of the green pellets are coated, is produced by crushing small size coke pieces generated in a quenching apparatus and a screening apparatus at the step of production of lumpish coke for a blast furnace, by means of a rod mill.

However, although powdery coke of small particle size is used for coating the surfaces of the green pellets, there is a problem in that powdery coke of comparatively large particle size remains unused. When the powdery coke of coarse grain size is used as fuel for a blast furnace, gas permeability in the blast furnace is poor.

SUMMARY OF THE INVENTION

It is an object of the present invention to manufacture agglomerates of sintered pellets by effectively utilizing coarse grain powdery coke.

To attain the aforementioned object, the present invention provides a method for manufacturing agglomerates of sintered pellets, comprising the steps of:

blending, mixing and pelletizing flux and coarse grain coke with fine iron ore;

coating green pellets obtained at the step of said mixing and pelletizing with powdery coke; and sintering the green pellets coated with the powdery coke.

The above objects and other objects and advantages of the present invention will become apparant from the detailed description which follows when considered in conjunction with the appended drawings.

DESCRIPTION OF THE PREFERRED EMBODIMENT

When fine iron ore, flux and coarse grain coke are mixed with each other, fine powder among the fine iron ore attaches to the pieces of surfaces of the coarse grain coke. When the mixture of the coarse grain coke, to which the fine powder has attached, the fine iron ore and the flux is pelletized by the use of a disk pelletizer, green pellets in which the fine iron ore attaches to the circumference of the coarse grain coke as a core, are produced. The green pellets are coated with the powdery coke. Agglomerates of sintered pellets can be produced by sintering the green pellets coated with the powdery coke in a travelling endless grate type sintering machine.

Figure 1:
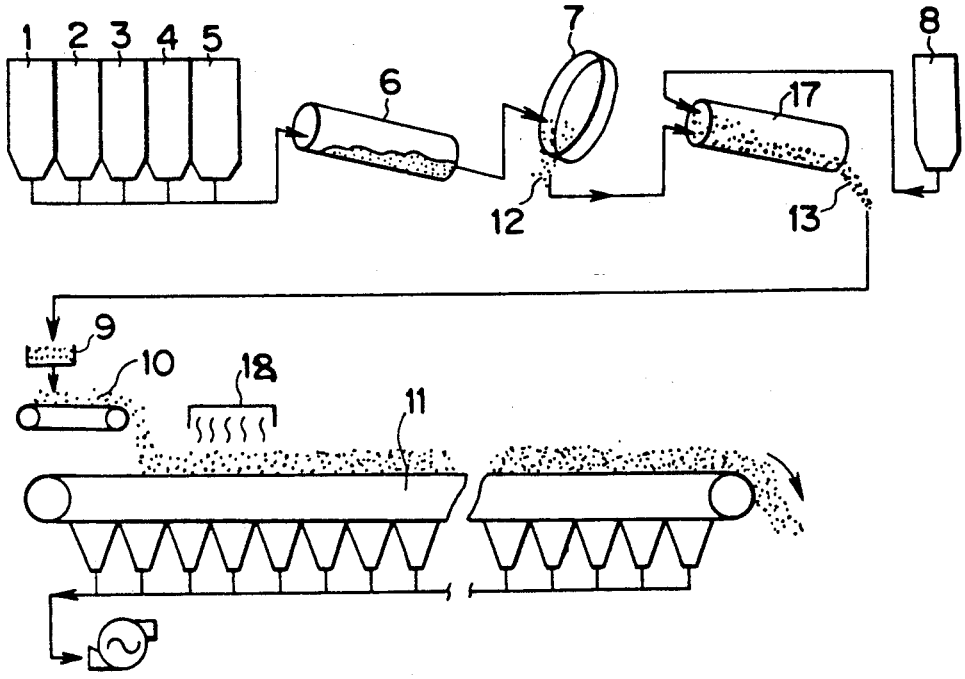
FIG. 1 is a schematic illusration of the method of the present invention.

FIG. 1 is a schematic illustration of the method of the present invention. In the drawing, reference numeral 1 denotes a storage tank for powdery iron ore for pellets, 2 a storage tank for fine iron ore for ordinary sintering materials, 3 a storage tank for return fines generated in the step of production of agglomerates of sintered pellets, 4 a storage tank for flux, 5 a storage tank for coarse grain coke of 1 to 7 mm in particle size, 6 a drum mixer, 7 a disk pelletizer, 8 a storage tank for powdery coke of less than 1 mm in particle size, 9 a shuttle conveyer, 10 a wide charging belt conveyer, 11 a travelling endless grate type sintering machine, and 18 a ignition furnace.

The respective predetermined amounts of fine iron ore, powdery iron ore, flux and coarse grain coke are cut out from each storage tank and supplied into the drum mixer 6. The fine iron ore, the powdery iron ore, the flux and the coarse grain coke are mixed with each other in the drum mixer 6 and a mixture thereof is obtained. This mixture is supplied into the disk pelletizer 7 and pelletized into green pellets 12 of to 5 to 10 mm in particle size, water being added to the mixture. The coarse grain coke as a core is incorporated into said green pellets 12. The green pellets 12 are supplied into the drum mixer 17 and mixed. Water and the powdery coke cut out from the storage tank 8 for powdery coke are added to the green pellets 12. Green pellets 13, whose surfaces are coated with the powdery coke, are produced by the mixing. The green pellets 13, coated with the powdery coke, are charged into the sintering machine 11 through the shuttle conveyer 9 and the charging conveyer 10. The surfaces of the green pellets charged into the sintering machine are ignited in the ignition furnace 18, and the green pellets are sintered by sucking air downward. Sintered cakes obtained by sintering convert to agglomerates of sintered pellets through the steps of crushing and screening.

Figure 2:
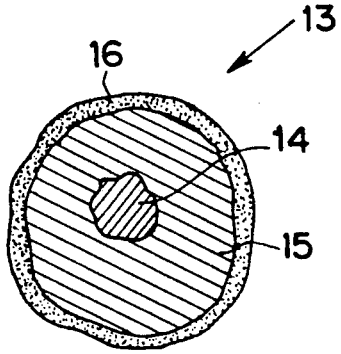
FIG. 2 is a sectional view schematically illustrating green pellets coated with powdery coke produced according to the present invention.

FIG. 2 is a sectional view schematically illustrating a green pellet coated with the powdery coke, which is produced in the production steps of the present invention. In the drawing, reference numeral 14 denotes a coarse coke grain, 15 denotes a layer of the fine iron ore which is formed by attaching to the circumference of the coarse coke grain 14 as the core, and 16 denotes a layer of the powdery coke attaching to the circumference of the layer 15 of the fine iron ore. When such green pellets 13 are charged into the sintering machine 13 and sintered therein, the layer 14 of the powdery coke is combusted. The layer 15 of the fine iron ore is sintered by combustion heat of the powdery coke, and the outer surfaces of the layer 15 of the fine iron ore are melted such that agglomerates of sintered pellets in which sintered pellets attach to each other are produced. Although the powdery coke is combusted, the coarse grain coke in the green pellets remains uncombusted. The sintered cake converts to agglomerates of sintered pellets through crushing and screening. Since the coarse grain coke is present in the sintered pellets constituting the agglomerates of sintered pellets when it is is charged into a blast furnace, deterioration of permeability inside the blast furnace is not produced. However, direct charging of the coarse grain coke into the blast furnace interferes with the permeability inside the blast furnace.

The agglomerates of sintered pellets obtained by the aforementioned method and lumpish coke are charged into the blast furnace. Since the coarse grain coke in the agglomerates of sintered pellets is combusted in a process in which the agglomerates of sintered pellets are reduced and melted in the blast furnace, the coarse grain coke can be used for fuel. The unit consumption of the lumpish coke is decreased by the amount of the lumpish coke corresponding to combustion heat of the coarse grain coke. When the blend ratio of the coarse grain coke to 100 parts of the fine iron ore and the powdery iron ore, by weight, is 10% parts by weight, the unit consumption (500 kg/T-pig) of the lumpish coke during the use of the prior art agglomerates of sintered pellets can be decreased by around 50 kg/T-pig.

The particle size of the coarse grain coke constituting the core of the green pellets is desired to be from 1 to 7 mm. When the particle size of the coarse grain coke exceeds 7 mm, the particle size of the agglomerates of sintered pellets as a product becomes large, which is not desirable. When the particle size of the coarse grain coke is below 1 mm, the coarse grain coke cannot be the core of the green pellets. The particle size of the coarse grain coke is desired to be from 1 to 3 mm.

The blend ratio of the coarse grain coke to 100 parts of the total of the fine iron ore and the flux by weight is desired to be from 1 to 50 parts by weight. When the blend ratio exceeds 50 parts by weight, the combustion heat of the agglomerates of sintered pellets exceeds the heat necessary for the blast furnace. When the blend ratio is less than 1 part by weight, the effect of the agglomerates of sintered pellets, as a substitute for lumpish coke, to be charged into the blast furnace is small. The blend ratio is preferred to be from 3 to 30 parts by weight.

The powdery coke of less than 1 mm in particle size, with which the green pellets are coated, is usually used. The powdery coke of less than 0.125 mm is preferred, due to its good coating property. The blend ratio of the powdery coke to 100 parts of the total of the fine iron ore and the flux by weight is desired to be from 3 to 4 parts by weight. Agglomerates of sintered pellets, excellent in reducibility, can be produced with a blend ratio of 3 to 3.5 parts by weight, which is preferred.

What is claimed is:

1. A method for manufacturing agglomerates of sintered pellets comprising the steps of: blending, mixing and pelletizing flux and coarse coke grains with fine iron ore whereby the fine iron is attached to circumferences of the coarse coke grains to produce green pellets, said coarse coke grains being incorporated as a core into said green pellets and having a particle size of 1 to 7 mm, 1 to 50 parts of said coarse coke grains being added to 100 parts of the total amount of the fine iron ore and flux by weight;

coating said green pellets with powdery coke, said powdery coke having a particle size of 1 mm or less; and sintering said green pellets coated with the powdery coke, agglomerates of sintered pellets being produced, said sintered pellets incorporating coarse coke grains.

2. The method of claim 1, wherein said coarse coke grains has a particle size of 1 to 3 mm.

3. The method of claim 1, wherein 3 to 30 parts of said coarse coke grains by weight are added to 100 parts of the total amount of the fine iron ore and the flux by weight.

4. The method of claim 1, wherein said powdery coke has a particle size of at most 0.125 mm.

5. The method of claim 1, wherein 3 to 4 parts of said powdery coke by weight are added to 100 parts of the total amount of the fine iron ore and the flux by weight.

6. The method of claim 1, wherein said agglomerates of sintered pellets have sintered pellets attaching to each other.

7. The method of claim 1, wherein said coarse coke grains have a particle size of 1 to 3 mm;

3 to 30 parts of said coarse coke grains by weight are added to 100 parts of the total amount of the fine iron ore and the flux by weight; and said agglomerates of sintered pellets have sintered pellets attaching to each other.

* * * * *